US005941926A

United States Patent [19]

Taraki et al.

[11] Patent Number: 5,941,926

[45] Date of Patent: *Aug. 24, 1999

[54] ENGINE ANALYZER WITH CYLINDER TRIGGERING OF OSCILLOSCOPE DISPLAY HAVING FIXED-TIME SWEEP

[75] Inventors: Yosuf M. Taraki, Evanston; Dale A. Trsar, Mt. Prospect; Richard H. Shepherd, McHenry; Tyrone J. Moritz, Morton Grove; Mark H. Petersen, Mundelein, all of Ill.

[73] Assignee: Snap-on Technologies, Inc., Lincolnshire, Ill.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/629,813

[22] Filed: Apr. 10, 1996

[51] Int. Cl.[6] ..... G09G 5/36

[52] U.S. Cl. ..... 701/102; 345/134; 324/379; 702/68

[58] Field of Search ..... 364/431.04, 550, 364/424.038, 431.1, 431.12, 487, 431.03, 551.01, 481; 345/24, 133, 140, 134, 165; 324/394, 379, 121 R, 384, 391, 397, 378, 392; 73/117.3, 116; 701/101, 102, 29, 30, 99; 702/66, 67, 68

[56] References Cited

U.S. PATENT DOCUMENTS

| | | | |
|---|---|---|---|
| Re. 29,984 | 5/1979 | Howes | 73/117.3 |
| Re. 31,656 | 9/1984 | Howes | 73/117.3 |
| 3,789,658 | 2/1974 | Olsen | 73/117.3 |
| 4,072,851 | 2/1978 | Rose | 364/487 |
| 4,472,779 | 9/1984 | Marino et al. | 701/99 |
| 4,476,531 | 10/1984 | Marino et al. | 701/99 |
| 4,779,028 | 10/1988 | Blair | 702/68 |
| 5,041,976 | 8/1991 | Marko et al. | 364/424.034 |
| 5,175,501 | 12/1992 | Loewe et al. | 324/380 |
| 5,258,753 | 11/1993 | Jonker et al. | 364/431.04 |
| 5,296,869 | 3/1994 | Jonker et al. | 364/431.04 |
| 5,375,067 | 12/1994 | Berchin | 702/66 |
| 5,414,635 | 5/1995 | Ohta | 364/481 |
| 5,495,168 | 2/1996 | De Vries | 364/487 |
| 5,680,311 | 10/1997 | Trsar et al. | 701/29 |
| 5,742,276 | 4/1998 | Taraki | 324/379 |

*Primary Examiner*—Jacques H. Louis-Jacques
*Attorney, Agent, or Firm*—Emrich & Dithmar

[57] ABSTRACT

An engine analyzer has an oscilloscope screen display operable with a fixed-time sweep. The analyzer includes a data acquisition system for digitizing analog input waveforms and a memory for storing the digitized waveform data, the analyzer including sensors for detecting each cylinder firing and the firing of the no. 1 cylinder for identification of the cylinders. A processor includes trigger means for controlling the triggering of the oscilloscope display at a trigger point which corresponds to the firing of a trigger cylinder which is selectable by the user, so that the displayed waveform data begins with the stored data for the selected trigger cylinder. The user can also selectively vary the location of the trigger point on the screen display.

11 Claims, 3 Drawing Sheets

ENGINE ANALYZER WITH CYLINDER TRIGGERING OF OSCILLOSCOPE DISPLAY HAVING FIXED-TIME SWEEP

BACKGROUND OF THE INVENTION

1. Field of the Invention

The present invention relates to engine analyzers and, in particular, to engine analyzers having digital oscilloscope displays.

2. Description of the Prior Art

Digital storage oscilloscopes are well known and typically have two modes of operation, viz., live and freeze. In the live mode, one or more selected input signals are repeatedly sampled by a data acquisition system and the resulting digitized waveform data is displayed on the screen of the oscilloscope and saved in memory. It is known in prior digital engine analyzers to store input waveform data in a memory which is divided up into sections. When the freeze mode is activated, data acquisition is suspended and the most recently-displayed section of waveform data remains "frozen" on the screen. At this point the operator can review previously acquired waveform data that has been saved in memory by recalling it from memory and displaying it on the screen.

It is known to provide digital oscilloscopes with multiple display traces (e.g., two), so that a number of waveforms can be simultaneously displayed. A dual-trace scope can typically be operated in either single-trace mode or dual-trace mode.

It is also known to provide engine analyzers with screen displays which essentially constitute digital oscilloscopes. In the case of a multi-cylinder internal combustion engine, two of the engine waveforms which are commonly displayed on an engine analyzer scope are the primary and secondary ignition voltages which appear, respectively, across the primary and secondary windings of the ignition coil. The primary and secondary waveforms are typically acquired from the engine by means of separate primary and secondary pickup leads. The analyzer also typically has a no. 1 cylinder lead to detect the firing of the no. 1 cylinder so that the analyzer can identify the cylinders once the firing order of the engine is known. Other leads may be utilized to acquire other types of waveforms generated by the engine.

The horizontal scale (also called sweep) of an oscilloscope screen represents time. Broadly speaking, in a digital engine analyzer scope there are two types of sweeps: engine sweeps and fixed-time sweeps. Engine sweeps display a waveform for either a single cylinder ignition or for a complete engine cycle (the time between consecutive firings of the same cylinder), and are typically used to display waveforms related to cylinder ignition events. For engine sweeps, the analyzer includes means for identifying the cylinder firings in the stored waveform data. Engine sweeps may be of any of three different types: cylinder, parade and raster. In a cylinder sweep, only a single cylinder waveform is displayed. In parade and raster sweeps, all of the cylinders for a complete engine cycle are displayed simultaneously on the screen, the cylinders being displayed in horizontal progression across the width of the screen in a parade sweep and being stacked vertically one atop the other in a raster sweep. Since engine sweeps begin and end with the firing of a cylinder, the time represented by an engine sweep varies with engine speed. Fixed-time sweeps (e.g., 10 ms, 100 ms, etc.) display a fixed period of time across the width of the screen display, and are typically used to display waveforms other than primary and secondary waveforms.

An oscilloscope screen essentially displays snapshots of discrete portions of the waveform representing an electrical signal. The mechanism which determines the starting point for each snapshot is referred to as triggering. Prior digital analyzer scopes have supported three types of triggering, viz., auto, signal and cylinder triggering. Auto triggering occurs randomly on a periodic basis, the repeat rate being determined by the selected horizontal time scale. Signal triggering occurs when the displayed signal crosses a threshold level with either a rising or a falling slope. The threshold level and the slope can typically be set by the user. Cylinder triggering occurs when a selected cylinder of the engine under test is fired. This latter trigger mode is used to examine signals from the electrical system of the engine while synchronizing with a selected cylinder. Cylinder triggering normally requires that the no. 1 pickup and either a primary or secondary signal pickup be connected to the engine.

It is known in prior digital engine analyzers to operate the analyzer in either ignition scope mode or a standard lab scope mode. The ignition scope mode is normally used for analyzing primary and secondary waveforms. The lab scope mode is typically used for analyzing waveforms other than primary and secondary waveforms, the display of which other waveforms utilizes a fixed-time sweep. Accordingly, such prior analyzers must use either auto or signal triggering when operating in the lab scope mode and, similarly, are typically constrained to use cylinder triggering when operating in the cylinder or ignition scope mode. Thus, prior engine analyzers do not permit cylinder triggering when viewing a waveform with a fixed-time sweep.

SUMMARY OF THE INVENTION

It is a general object of the invention to provide an improved method and apparatus for analyzing waveforms of multi-cylinder internal combustion engines, which avoid the disadvantages of prior apparatus and methods while affording additional structural and operating advantages.

An important feature of the invention is the provision of a method for utilizing cylinder triggering of a waveform display with a fixed-time sweep.

In connection with the foregoing feature, another feature of the invention is the provision of a method of the type set forth, which affords user selection of the trigger cylinder from a control panel.

A further feature of the invention is the provision of an apparatus for performing the method of the type set forth.

Certain ones of these and other features of the invention are attained by providing a system for analyzing the operation of a multi-cylinder internal combustion engine in which the cylinders are fired in a predetermined firing ordering beginning with a no. 1 cylinder, the system comprising: sensing means adapted to be coupled to an associated engine for generating a cylinder clock signal indicative of the firing of each cylinder and a sync signal indicative of the firing of the no. 1 cylinder, waveform acquisition means adapted to be coupled to the associated engine for receiving analog input waveforms therefrom and generating digitized waveform data representative of such analog waveforms, memory means for storing the digitized waveform data, means responsive to the cylinder clock signal and the sync signal for identifying cylinder firings, a display device having a screen display with a fixed-time sweep for displaying stored waveform data, processing means coupled to the memory means and to the display device and operating under stored program control for controlling storage and display of the waveform data, the processing means including trigger means for controlling the triggering of the display device at a trigger point which corresponds to the firing of a preselected trigger cylinder so that the displayed waveform data includes data for a period of time beginning with the firing of the trigger cylinder, and switch means operable for selecting the trigger cylinder for triggering the display device.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
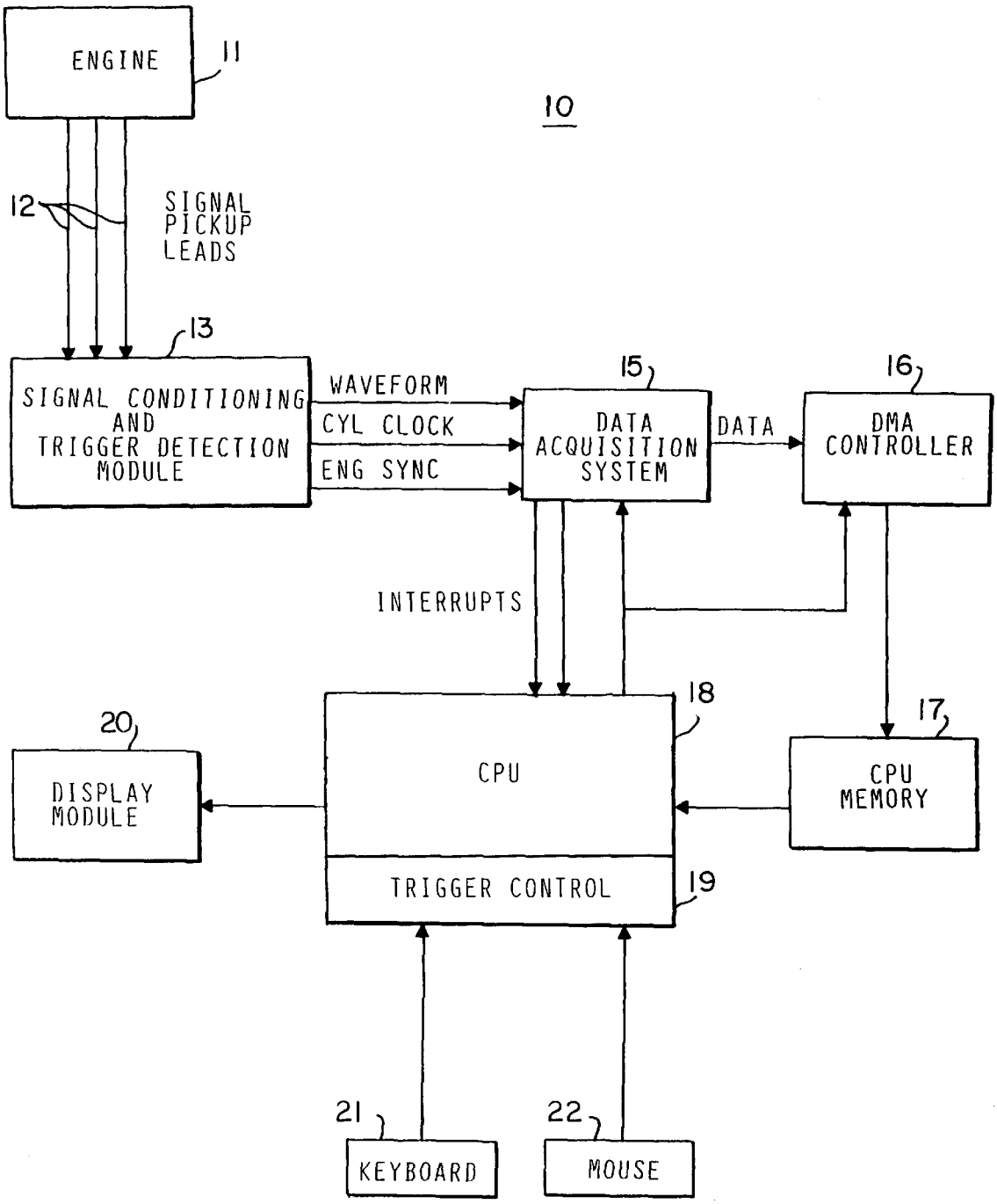
FIG. 1 is a functional block diagram of an engine analyzer system incorporating a digital oscilloscope display in accordance with the present invention.

Referring to FIG. 1, there is illustrated an engine analyzer, generally designated by the numeral 10, in accordance with the present invention. The engine analyzer 10 is adapted for analyzing the operation of an associated multi-cylinder internal combustion engine 11 by, inter alia, monitoring analog waveform signals generated by the engine 11. In this regard, the analyzer 10 is provided with a plurality of signal pickup leads 12 adapted for connection to selected points in the engine 11 for acquiring input signals therefrom. While three such leads have been shown in FIG. 1, this is simply for purposes of illustration, and it will be appreciated that a larger number of leads may be provided. The signal pickup leads 12 preferably include a no. 1 cylinder probe for coupling to the no. 1 cylinder and primary and secondary leads for, respectively, acquiring the voltages on the primary and secondary windings of the ignition coil, all in a known manner. Other auxiliary leads may be provided for acquiring other signals, including non-ignition related signals, which auxiliary leads may include general-purpose voltage pickup probes, which will hereinafter be referred to as "pinpoint" leads.

The signal pickup leads 12 are coupled to a signal conditioning and trigger detection module 13, which performs pre-conditioning operations on the input waveform signals and passes the waveform signals to a data acquisition system 15. The signal conditioning and trigger detection module 13 also generates two digital signals, a cylinder clock signal indicating the firing of each cylinder, and an engine sync signal indicative of the firing of the no. 1 cylinder, which latter signals are also supplied to the data acquisition system 15, which digitizes the analog input waveform signals to produce digitized waveform data. The digitized waveform data is passed to a direct memory access (DMA) controller 16, which controls its storage in a memory 17.

The analyzer 10 also includes a central processing unit (CPU) 18 which includes a trigger control function 19 and is coupled to each of the data acquisition system 15, the DNA controller 16 and the memory 17, as well as to a display module 20. The CPU 18, under program control, controls the operation of the data acquisition system 15 and the DMA controller 16 and also receives interrupts from the data acquisition system 15, which interrupts may be responsive, inter alia, to the cylinder clock signals. The CPU 18 also controls transfer of stored waveform data from the memory 17 to the display module 20 for display, and also controls the various operational modes of the display module 20. In this regard, the display module 20 is preferably a color oscilloscope display and is operable in live and freeze modes, in single-trace and dual-trace modes, with various sweeps and with various types of triggering, the latter being controlled by the trigger control function 19. User selection of these and other parameters is effected through an appropriate user interface, which may include a keyboard 21 and/or a mouse 22 which are coupled to the CPU 18.

The display module 20 is provided with a plurality of different fixed-time sweeps and the usual cylinder, parade and raster engine sweeps, as described above in connection with prior engine analyzers. In addition, the display module 20 is preferably provided with 5 ms engine sweeps, which are similar to the standard engine sweeps discussed above, except that only the first 5 ms of each cylinder is plotted. There are 5 ms engine sweeps corresponding to each of the standard engine sweeps, viz., cylinder 5 ms, parade 5 ms and raster 5 ms.

When the display module 20 is operating in dual-trace mode, a number of restrictions apply to the combinations of sweeps allowed on the two traces. If the first trace is a fixed-time sweep, the sweep for the second trace is forced to have the same sweep as the first trace. If the first trace is an engine sweep, the second trace must also be an engine sweep, although it can be a different engine sweep. For example, the first trace can be a cylinder sweep and the second trace can be a parade sweep. If the first trace is a 5 ms engine sweep, the second trace must also be a 5 ms engine sweep. For example, the first trace can be a cylinder 5 ms sweep and the second trace can be a parade 5 ms sweep. Thus, the sweeps for the two traces must be of the same type. It will be appreciated that these rules are enforced by the operating software of the central processing unit 18 in a manner which precludes invalid combinations.

The digital waveform data in the analyzer 10 is managed and stored in the memory 17 by frames, wherein a frame is the waveform data for the time period across the width of the screen display in the case of a fixed-time sweep. The cylinder clock and engine sync signals permit the analyzer 10 to keep track of the cylinders in a known manner.

The engine analyzer 10 supports all of the three standard types of triggering for digital display scopes in engine analyzers, viz., cylinder triggering, automatic triggering and signal triggering. Engine sweeps and 5 ms engine sweeps use cylinder triggering. Fixed-time sweeps use either automatic or signal triggering, as is standard in prior art digital scopes and engine analyzers. However, it is a significant aspect of the present invention that the analyzer 10 also supports the use of cylinder triggering with fixed-time sweeps.

Figure 2:
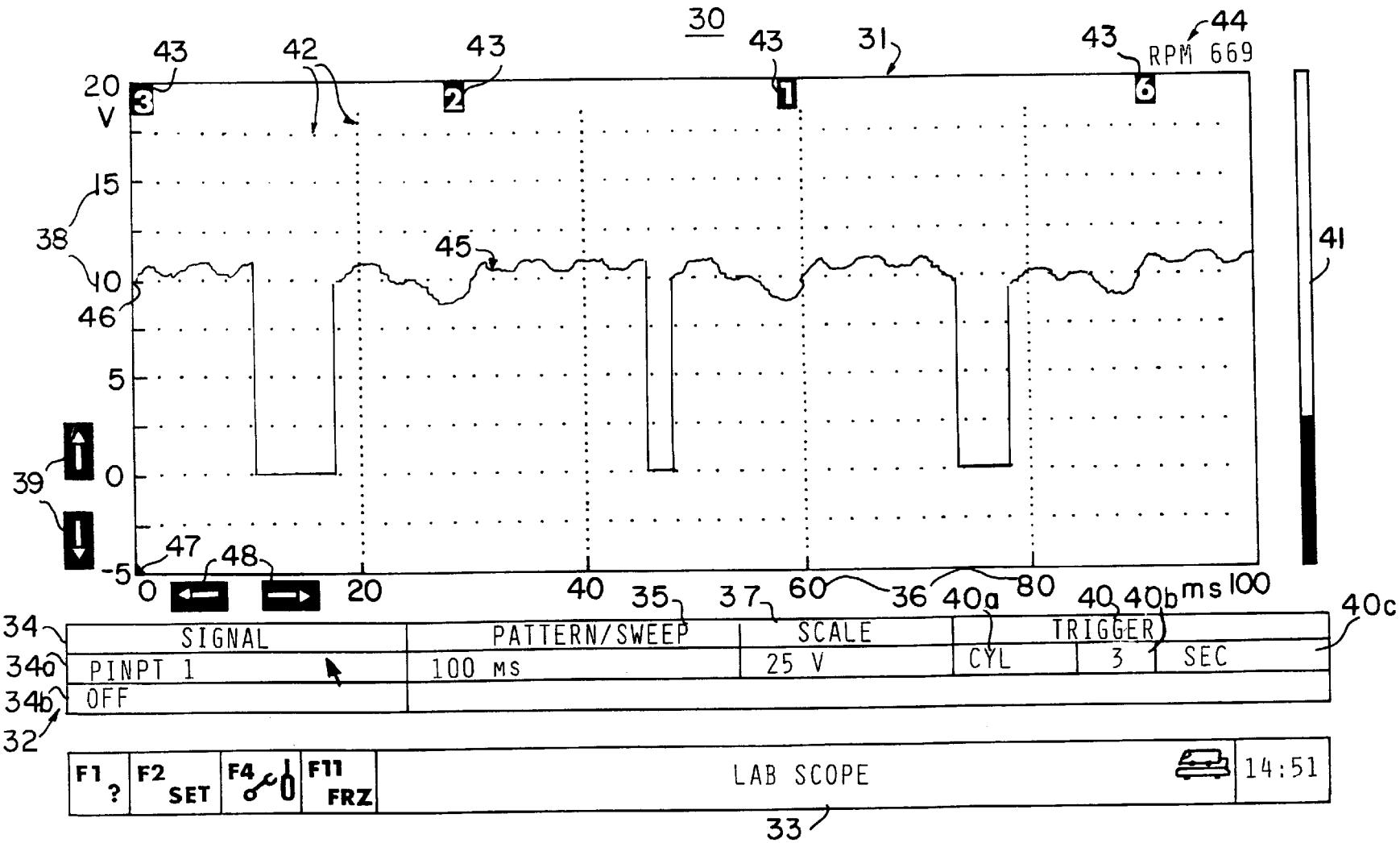
FIG. 2 is a screen display obtainable with the engine analyzer system of FIG. 1.

Referring now to FIG. 2, there is illustrated a screen display 30 which is one of a number of screen displays available with the engine analyzer 10, which will be useful for explaining the significant aspects of the invention. The screen display 30 is set up in a single-trace display mode, so that it has a single rectangular waveform plot area 31 for displaying a waveform along a horizontal axis or trace. Displayed below the waveform plot area 31 is a control panel area 32, including a number of icons and indicators in the nature of rectangular boxes in which text or other indicia may be displayed, the boxes being arranged in horizontal rows. In the lowermost row is a scope mode indicator 33, which indicates the selected scope mode. In this case the indicated mode is "Lab Scope", which is typically used for displaying signals other than primary and secondary signals. In Lab Scope mode, the display module 20 always uses a fixed-time sweep. Another common mode (not shown) is Ignition Scope, which is used for displaying primary and secondary ignition waveforms. An engine sweep is always used in the Ignition Scope mode.

The control panel area 32 also includes a Signal icon 34, which includes boxes 34*a* and 34*b* for respectively indicating the signals displayed in the two traces of the dual-trace display scope. In each of these boxes, the user can select from among a plurality of different signal options, with different options respectively corresponding to different ones of the signal pickup leads 12. In this case, the signal displayed on the first trace is the signal appearing on the "pinpoint 1" lead. For the box 34*b,* one of the available options is "OFF". When this option is selected, as in FIG. 2, the second trace is OFF so that the scope is operating in single-trace mode.

There is also a Pattern/Sweep icon 35 which indicates the selected sweep, in this case a 100 ms fixed-time sweep. As was indicated above, since a Lab Scope display mode has been selected, only fixed-time sweeps can be used. Time indicia 36 indicating the sweep time scale are displayed across the bottom of the waveform plot area 31 in 20 ms increments.

There is also provided a Scale icon 37 which indicates the scale of the plot area 31 along the vertical axis. In this case a 25-volt scale has been selected. Accordingly, scale indicia 38 are arranged in 5-volt increments along the left-hand side of the waveform plot area 31. In this case, it will be noted that the zero level of the scale is set so that the scale goes from −5 volts to +20 volts. The location of this zero level can be selectively changed by the use of control arrows 39.

The control panel area 32 also includes a Trigger icon 40, which includes a box 40*a* for indicating which one of the three types of triggering has been selected. In accordance with the present invention, the user can select from among not only auto and signal triggering, as in the prior art, but also cylinder triggering, as in FIG. 2. When cylinder triggering is selected, the icon 40 also includes a box 40*b* which indicates the particular cylinder which is being used as the trigger. The icon 40 also includes a box 40*c* which indicates the particular one of signal pickup leads 12 from which the trigger signal is being acquired, in this case the secondary lead.

It will be appreciated that, normally, each of the icons 35, 37 and 40 includes vertically arranged boxes respectively corresponding to the two traces of the scope. However, in this case, since a single-trace mode has been selected, the boxes corresponding to the second trace are eliminated.

The screen display 30 also includes a memory buffer icon 41 in the nature of a narrow vertical box arranged along the right-hand side of the waveform plot area 31 which, in the live display mode illustrated in FIG. 2, illustrates by the darkened area the portion of the memory storage buffers which are filled. It will also be noted that the waveform plot area 31 is provided with horizontal and vertical dotted grid lines 42, respectively aligned with the vertical and horizontal scale indica. If desired, these grid lines can be selectively turned off by the user. There are also displayed in the waveform plot area 31 cylinder indicia 43 which indicate the cylinder numbers and the points at which the respective cylinders are fired. These indicia may also optionally be turned off. An RPM indicator 44 is also provided in the upper right-hand corner of the screen indicating the current speed of the engine under test.

As can be seen in FIG. 2, the screen display 30 includes other icons, indicators and other types of indicia which are not pertinent to the present invention and, therefore, are not discussed herein.

A waveform 45 is plotted in the waveform plot area 31, a starter crank signal being shown for purposes of illustration. By default, the trigger point 46 of the of the waveform display is positioned at the left-hand edge of the waveform plot area 31. This trigger point is indicated by a trigger cursor 47, which is a triangular icon, only half of which is illustrated in FIG. 2, since the apex of the triangle signifies the trigger point. Note that the cylinder indicium 43 for cylinder 3, the selected trigger cylinder in this case, also appears in vertical alignment with the trigger cursor 47. The position of the trigger point on the screen can be selectively shifted to coincide with any of the time indicia 36, in a manner described below.

In general, each of the several icons in the control panel area 32 represents a switch, which can be operated by the user by means of either the keyboard 21 or the mouse 22. For the icons above the bottom row, i.e., icons 34, 35, 37 and 40, the icon box with respect to which a selection is to be made is first activated, activation being indicated on the screen by emphasizing the icon. Emphasis is indicated by a thickened or brightened border around the box. Thus, in FIG. 2 box 34*b* is emphasized. With the keyboard 21, the arrow keys are used to shift the activation and emphasis to the appropriate box and then the "+" and "−" keys are used to increment or decrement the selections within the emphasized box. With the mouse 22, the mouse is clicked once on the box to be activated to emphasize it. Then each subsequent click of the mouse button on the emphasized icon will index the switch one option forward. Alternatively, the mouse button can be held down, locking the cursor within the emphasized box, and the mouse is then moved up and down to scroll the available options through the emphasized box. The option within the emphasized box is selected as soon as it appears in the box. In this manner, the user can selectively change the trigger mode by use of the icon box 40*a*. When trigger cylinder is selected, the default trigger cylinder is the no. 1 cylinder, which the user can change by use of the icon box 40*b*.

Adjustment of the trigger offset, i.e., the position of the trigger point 46 on the screen, is by a slightly different technique. With the keyboard 21, the user activates the Pattern/Sweep box and then uses the "page up" and "page down" keys to shift the trigger cursor 47 to the right or to the left, with each operation of the key shifting the cursor one time-scale division, in this case 20 ms. By use of the mouse 22, the user places the mouse cursor on the appropriate one of the arrow icons 48 and then clicks the mouse button, with each click jumping the trigger cursor 47 one scale division (20 ms in this case) either right or left, depending upon which arrow is selected.

While the above-described switch selection techniques are used in the preferred embodiment, it will be appreciated that the engine analyzer 10 could be programmed so that switch selections could be made with other combinations of operations of the keyboard 21 and/or the mouse 22.

Figure 3:
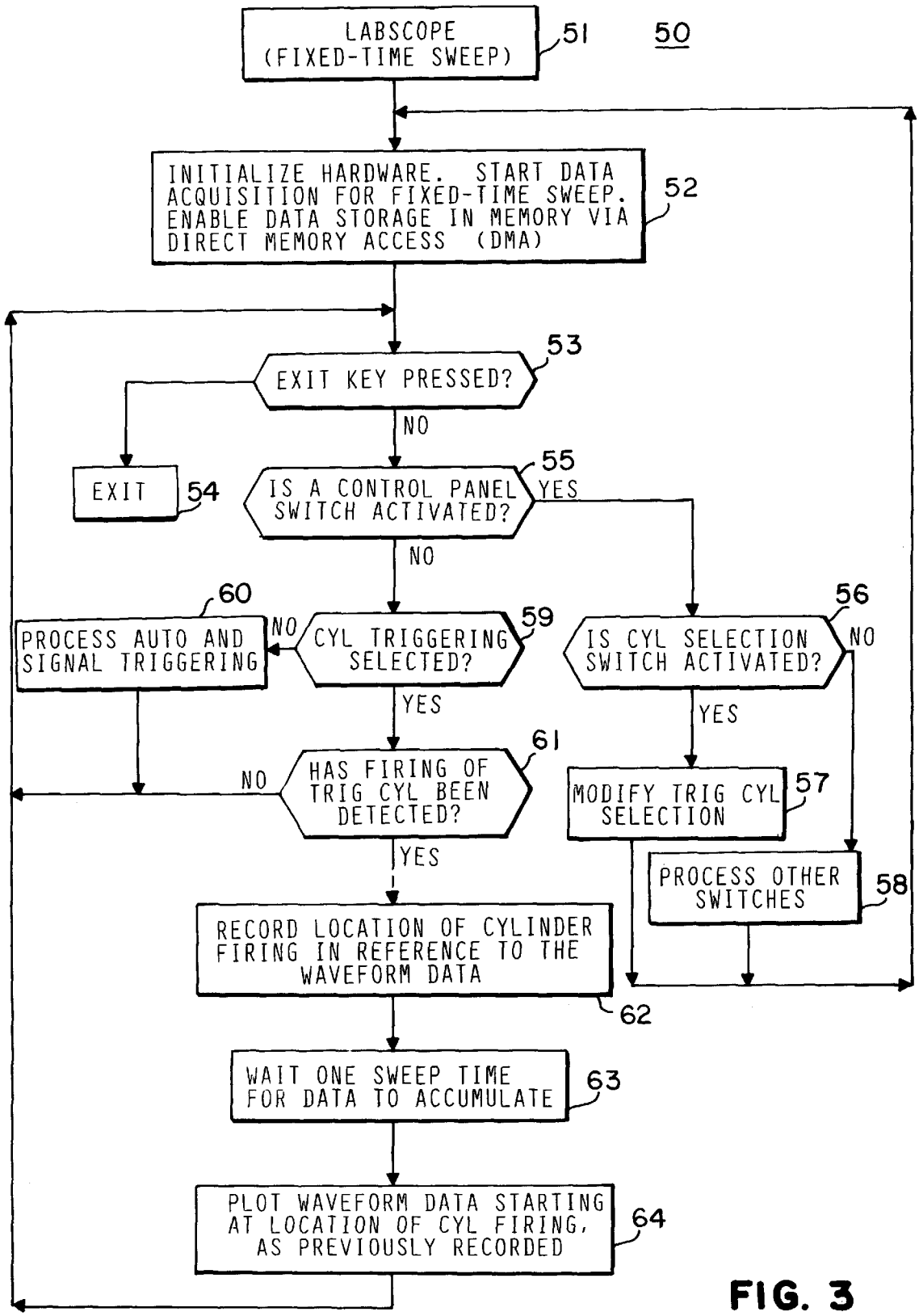
FIG. 3 is a flow chart diagram of a software program of the engine analyzer of FIG. 1 for controlling the triggering of the waveform display.

Referring now to FIG. 3, there is illustrated a flow diagram 50 indicating the triggering selection routine when the display module 20 is operating in the Lab Scope or fixed-time sweep mode. When the lab scope mode is entered at 51, the program first at 52 initializes the hardware and starts data acquisition by the data acquisition system 15 for a fixed-time sweep and enables data storage in the memory 17 via the DMA controller 16. Then, at 53 the program checks to see if the EXIT key has been pressed. If so, the routine is exited at 54. If not, the program next asks at 55 if a control panel switch has been activated. If so, the program checks at 56 to see if it is the cylinder selection switch of icon 40*a*. If so, it modifies the trigger cylinder selection accordingly at 57 and then returns to block 52. If it was not the cylinder selection switch, the program processes the other switches at 59 before returning to block 52.

If, at 55, a switch was not activated, the program checks at 59 to see if cylinder triggering has been selected. If not, the program processes auto and signal triggering at 60 and then returns to decision 53. If cylinder triggering has been selected, the program checks at 61 to see if the firing of the selected trigger cylinder has been detected. If it has, the program then, at 62, records the location of the cylinder firing with reference to the waveform data, and then at 63 waits one sweep time for waveform data to accumulate. Then, at 64, the program plots the waveform data starting at the trigger cylinder firing as previously recorded, or if there is a trigger offset, starting the trigger offset time prior to the firing of the trigger cylinder, and returns to decision 53. If, at 61, the firing of the trigger cylinder has not been detected, the program returns immediately to decision 53.

From the foregoing, it can be seen that there has been provided an improved engine analyzer which permits the use of cylinder triggering with a fixed-time sweep on an oscilloscope display, while also permitting user-selection of the trigger cylinder.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A system for analyzing the operation of a multi-cylinder internal combustion engine in which the cylinders are fired in a predetermined firing order beginning with a no. 1 cylinder, said system comprising:

sensing apparatus for coupling to an associated engine for generating a cylinder clock signal indicative of the firing of each cylinder and a sync signal indicative of the firing of the no. 1 cylinder, a waveform acquisition circuit for coupling to the associated engine for receiving analog input waveforms therefrom and generating digitized waveform data representative of such analog waveforms, a memory for storing the digitized waveform data, means responsive to the cylinder clock signal and the sync signal for identifying cylinder firings, a display device having a screen display with a fixed-time sweep for displaying stored waveform data, a processor coupled to said memory and to said display device and operating under stored program control for controlling storage and display of the waveform data for a period of time beginning with the firing of a preselected trigger cylinder, and a switch coupled to the processor and operable for selecting any one of the cylinders as the trigger cylinder for triggering the display device.

2. The system of claim 1, wherein said switch includes an icon on the screen display, and a user interface for changing the condition of said icon.

3. The system of claim 2, wherein said interface includes a keyboard.

4. The system of claim 2, wherein said interface includes a mouse.

5. The system of claim 1, wherein said processor controls recording with reference to the waveform data the location of the firing of the trigger cylinder.

6. The system of claim 5, wherein said processor responds to the firing of the trigger cylinder for accumulating digitized waveform data in the memory for the fixed time of a sweep before beginning display of the stored waveform data.

7. The system of claim 6, wherein said processor controls the location of the trigger point on the screen display.

8. A method for analyzing the operation of a multi-cylinder internal combustion engine in which the cylinders are fired in a predetermined firing order beginning with a no. 1 cylinder, said method comprising the steps of:

acquiring and digitizing an analog input waveform from the engine to produce digitized waveform data representative of the analog input waveform, storing the digitized waveform data, selecting any one of the cylinders as a trigger cylinder, and displaying stored waveform data on a screen display having a fixed-time sweep triggered by firing of the selected trigger cylinder.

9. The method of claim 8, and further comprising the step of recording with respect to the waveform data the location of the firing of the trigger cylinder.

10. The method of claim 9, and further comprising the step of accumulating digitized waveform data for the fixed time of a sweep beginning with the firing of the trigger cylinder before displaying the stored waveform data.

11. The method of claim 10, and further comprising the step of selectively controlling the location on the screen display of the point corresponding to the firing of the trigger cylinder.

* * * * *